United States Patent [19]

Williams

[11] Patent Number: 4,704,854

[45] Date of Patent: Nov. 10, 1987

[54] FLEXIBLE COUPLING FOR A WIRE STRANDING MACHINE

[75] Inventor: Dean L. Williams, Rome, N.Y.

[73] Assignee: M.G.S. Manufacturing, Inc., Rome, N.Y.

[21] Appl. No.: 22,645

[22] Filed: Mar. 6, 1987

[51] Int. Cl.[4] ..... D07B 3/04

[52] U.S. Cl. ..... 57/58.34; 57/58.32

[58] Field of Search ..... 57/58.3–58.38, 57/59, 127.5, 127.7

[56] References Cited

U.S. PATENT DOCUMENTS

| | | | |
|---|---|---|---|
| 2,147,065 | 2/1939 | Somerville | 57/58.32 |
| 2,162,131 | 6/1939 | Somerville | 57/58.32 |
| 2,371,523 | 3/1945 | Jones | 57/58.34 |
| 2,416,126 | 2/1947 | Somerville | 57/58.32 |
| 3,456,433 | 7/1969 | Cloostermans-Huwaert | 57/59 |
| 3,693,337 | 9/1972 | Fevre | 57/58.34 X |
| 3,830,050 | 8/1974 | Ueda | 57/58.34 |
| 4,114,361 | 9/1978 | Berges et al. | 57/58.32 |
| 4,640,087 | 2/1987 | Targa et al. | 57/58.36 |

*Primary Examiner*—John Petrakes

*Attorney, Agent, or Firm*—Bruns and Wall

[57] ABSTRACT

A stranding machine for the production of rope from a plurality of strands comprises a rotary tube formed of two or more tube sections coupled end to end to rotate about a common axis. A flexible connector joins adjacent ends of successive ones of the tube sections. In this flexible connector, a pair of spiders have a central mounting hub and spokes whose ends are affixed to the cylindrical wall of the associated tube section. A rigid metal barrel connector has a cylindrical body and radial end flanges. A pair of resilient flexible coupling rings connect respective end flanges of the barrel connector to the spider mounting hubs. This arrangement employing two flexible elements accommodates both angular and parallel misalignment of successive tube sections.

12 Claims, 9 Drawing Figures

FLEXIBLE COUPLING FOR A WIRE STRANDING MACHINE

BACKGROUND OF THE INVENTION

This invention relates to machines for producing ropes and cables, and is more particularly directed to machines of the type in which a rotating tube carries a number of cradles, each of which remains stationary while the tube rotates about it, and each of which feeds a strand to form the rope or cable. In systems of this type several tube sections can be joined end to end for producing a rope or cable of a larger number of strands.

The invention is more specifically directed to support arrangements which flexibly support the tube sections and to coupling arrangement which can accommodate angular, axial and parallel misalignment when two or more sections are joined together in a cable stranding machine. The use of a flexible support is also valuable in a smaller machine with only one tube since it isolates vibration and protects the encircling bearing from abnormal loads which can occur with misalignment.

Tubular stranding machines, also known as Larmuth type machines, have been in use for many years and are well known. In these machines, the strander tube is supported by bearings or rollers and is rotated under power about its longitudinal axis. Within the tube, spools of single strand wire or fiber cord are rotatably mounted in cradles and the cradles in turn are supported by bearings at each end, the bearings being coaxial with the tube axis. The cradles are weighted at the bottom and do no rotate with the tube, but remain stationary. Normally one spool of wire or cord outside the tube feeds one strand into it, and the tube is built of tube sections each of which typically contains six cradles. Tubular stranding machines are commonly built with one, two or three sections, although there can be more when required. Sections are joined end to end when two or more are used. Cable constructions are most commonly seven strand, nineteen strand, and thirty-seven strand although not limited to these.

The strander tube typically rotates at speeds in excess of 2000 rpm, so it is imperative that the spools remain locked in their cradles. If either the cradle or the spool should shake free and contact the inside of the tube, serious damage to the machine would result.

In multiple section tubular stranding machines, it is impractical to interconnect tube sections with solid connectors so that the entire tube constitutes a rigid body over its entire length. Rigid couplings would require extremely careful alignment in order to avoid vibrating, abnormal bearing loads and fatigue failure. Flexible couplings are therefore preferred. Flexible couplings typically have equally spaced axial pins near the outer diameter of one tube engaging hole in the adjoining tube. These couplings are capable of compensating for angular misalignment, but not parallel misalignment or offset.

Stranding machines are typically forty-five feet long, and conventional stranding machines must be supported from the floor at close intervals and carefully aligned to assure parallel alignment between sections. These precautions are required to reduce transfer of vibration between sections and to keep bearing loads normal.

One previously proposed coupling system is described in U.S. Pat. No. 3,456,433, of July 22, 1969. Here, the tube sections are supported at each end by ball bearings, and the ends of the tube are of reduced diameter to reduce the bearing size. A tubular elastic member connects the outer surfaces of the reduced-diameter ends of the tube sections. However, the strands that exit one tube section must cross each other in precise paths in the reduced-diameter ends, and any parallel misalignment would disturb the passage of strands through them. Consequently, only angular misalignment can be tolerated. Although it has been proposed, e.g. in U.S. Pat. No. 3,693,337, to use elastic or resilient bearings supported on cushions for individual tubular sections that are disposed between cradles, no one has previously suggested that a flexible elastic member should be used to a bearing for a multiple spindle tube from a frame.

Another tubular rope stranding machine, proposed in U.S. Pat. No. 2,416,126, employs spiders at each end of the tube sections, and the spiders are joined by a universal joint, which can be rigid metal or stiff fiber. While this does permit some angular misalignment, it does not allow for axial displacement or offset of the tube sections relative to one another.

OBJECTS AND SUMMARY OF THE INVENTION

It is an object of this invention to provide a multiple-section rope stranding machine which is elastically coupled and supported so as to avoid the drawbacks of the prior art.

It is another object of this invention to provide a multiple-section stranding machine which can accommodate errors in alignment between the tube sections, and which will operate without problem at high speeds despite offset or parallel misalignment.

It is still another object of this invention to provide a multiple section stranding machine whose frame can be supported on a workroom floor at a minimal number of points, thereby facilitating set-up and operation.

According to one aspect of this invention, the stranding machine is formed of a plurality of tube sections joined end to end to rotate together. Encircling bearings supporting the tube are flexibly affixed to the main machine frame. A flexible connector couples the end of one tube section to a corresponding end of the next tube section and accommodates both angular, axial, and parallel misalignment.

The bearings each include an encircling bearing member having an inner race that is mounted to an outer surface of the tube section and an outer race that is supported by a bearing housing. A pair of flexible support bushings are positioned on respective rails of the frame to support the bearing housing. Preferably there are two such bearings for each tube section spaced one carriage in from each end of the tube section.

The flexible connectors each include a pair of spiders that have a central mounting hub and radial spokes that are affixed at ends of the tube sections. A barrel connector has a generally cylindrical body and radial flanges at each end, the flanges being in the form of regularly spaced lobes that define spaces or cutouts between them. A pair of rubber or rubber-like coupling rings join the flanges of the barrel connector to respective ones of the spider mounting hubs. Bolts or other fastening devices are spaced about each coupling ring, and alternately connect it to the spider mounting hub and to the barrel connector.

With the arrangement of this invention, the tube sections are isolated from vibration and noise, and factors such as thermal expansion and floor settling, which can impose heavy stress loads on previous systems, can be readily accommodated with the stranding machines of this invention.

The above and many other objects, features, and advantages of this invention will become apparent from the ensuing detailed description of a preferred embodiment, which should be considered in connection with the accompanying drawing.

DETAILED DESCRIPTION OF THE PREFERRED EMBODIMENT

Figure 1:
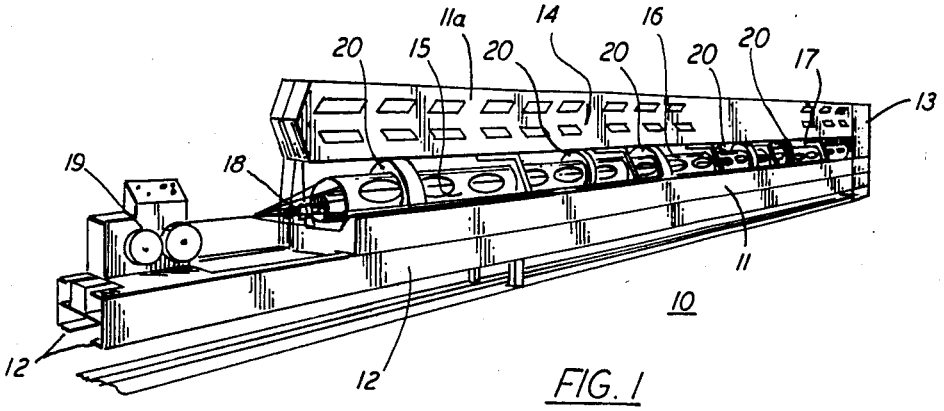
FIG. 1 is a perspective view of a tube-type wire rope stranding machine according to an embodiment of this invention.

With reference to the drawing, and initially to FIG. 1, a tube-type stranding machine 10 is shown formed of a housing 11 having a sound-insulating cover 11*a* mounted on a frame 12. The latter is constituted, for example, by a pair of parallel rails. A motor (not shown) is located below housing 11, or sometimes on top of housing 11 for rotationally driving a winding tube 14. The rails 12 run parallel to and beneath the tube 14. In this embodiment, the stranding machine 10 is arranged for forming nineteen-strand rope. The tube 14 is formed of three consecutive tube sections 15, 16, 17 with a nineteen-wire nose assembly 18 at the outlet end of the tube section 15. A capstan 19 draws the wire strands out from the tube 14 at a constant speed that is proportional to the rotational speed of the tube 14. In this embodiment there are five encircling bearing assemblies 20 provided for supporting the three tube sections 15, 16, 17 on the frame 12; one bearing assembly 20 for the first tube section 17 and two bearing assemblies 20 being provided for each of the tube sections 15 and 16. Each tube section 15, 16, 17 is divided into six compartments 21, with each compartment containing a wire cradle 22 supported in known fashion inside it.

Figure 2:
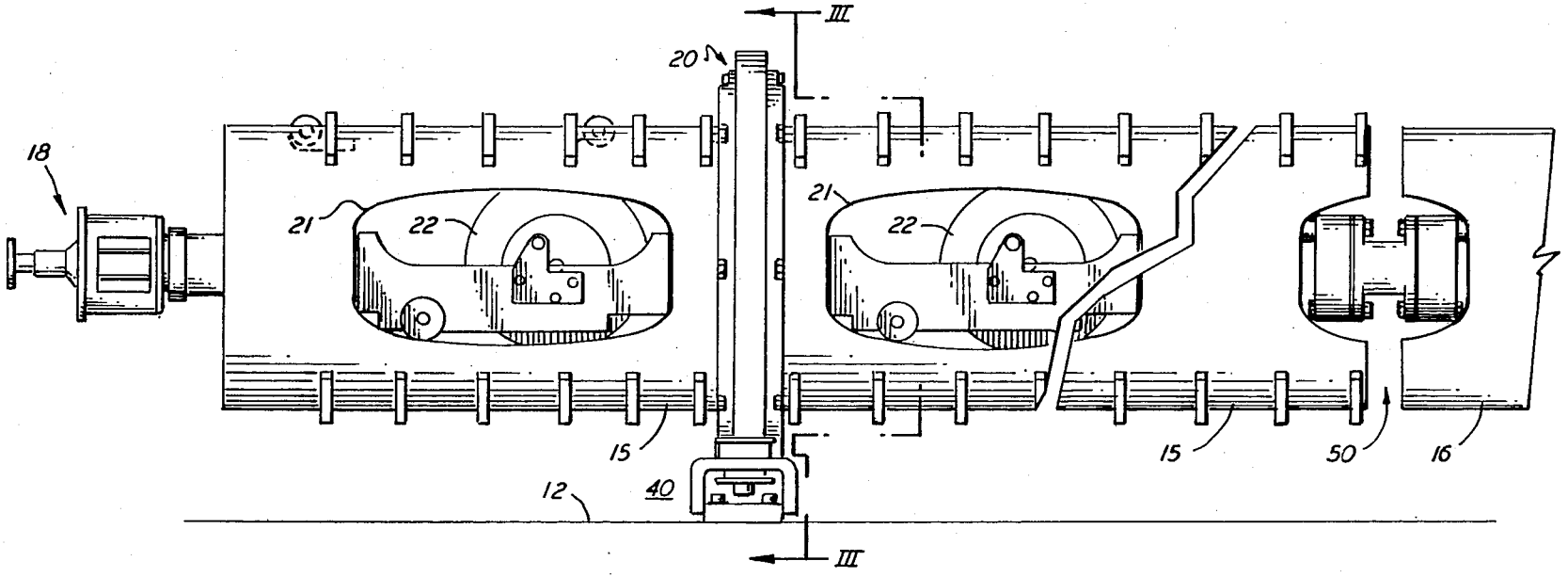
FIG. 2 is a side elevation of portions of a tube section from the stranding machine of FIG. 1, showing the flexible support for mounting the encircling bearings and also showing a flexible connector for joining successive tube sections.

Detail of the tube 14, including portions of tube sections 15 and 16, is shown in FIG. 2, where one of the bearing assemblies 20 is shown. The latter is shown in more detail in FIGS. 3 and 4. The bearing assembly 20 is formed of a generally annular bearing housing 23 which has bearing retainers 24 and 25 attached at its inner circumference. A bearing mounting ring 26 is affixed on an outer cylindrical surface of the tube section 15. An encircling ball bearing 27 has an outer race 28 held between the bearing retainers 24, 25 and an inner race 29 which is held to the mounting ring 26 by a number of keepers 30 (one is shown in FIG. 4), the keepers 30 being compressed against the inner race 29, for example, by respective set screws 31. Gaps 32 are defined between the bearing retainers 24, 25 and the mounting ring 26. Also shown are cap screws 33 which attach the bearing retainers 24 and 25 to the housing 23.

Figure 3:
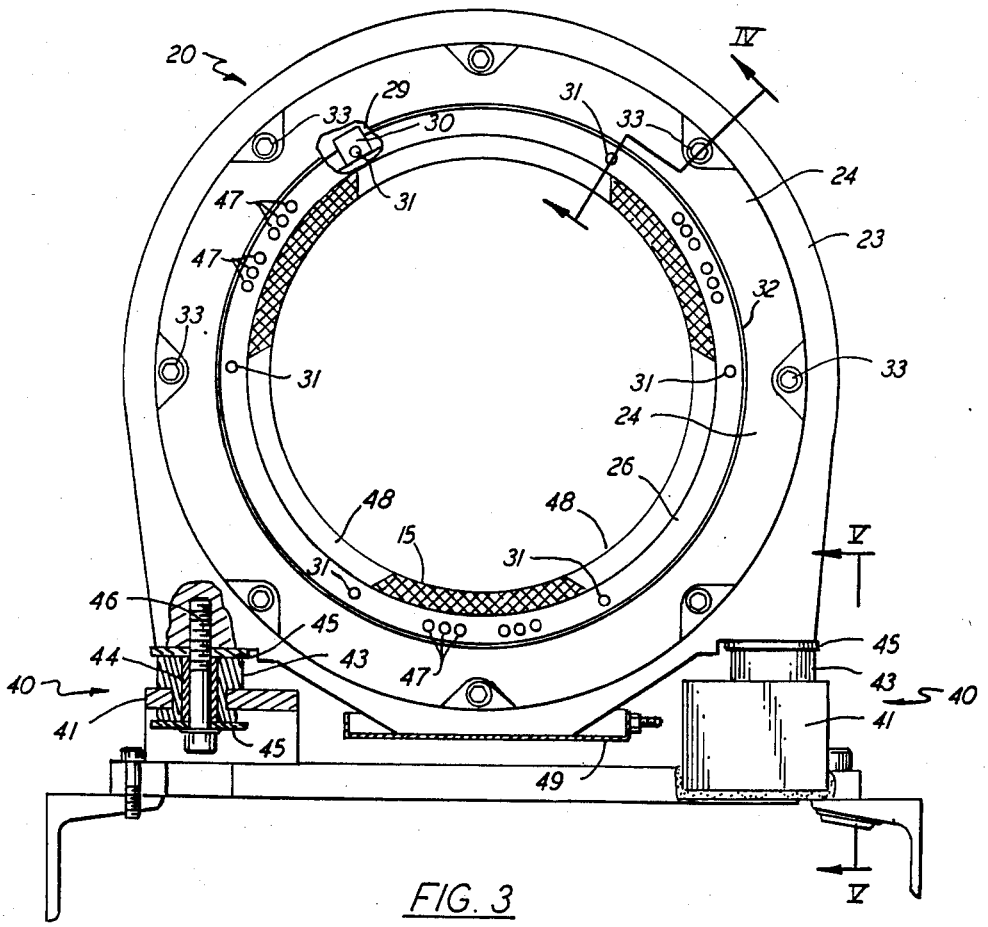
FIG. 3 is a cross section taken along lines III—III of FIG. 2 and illustrating the resilient mounting of the encircling bearing.
Figure 5:
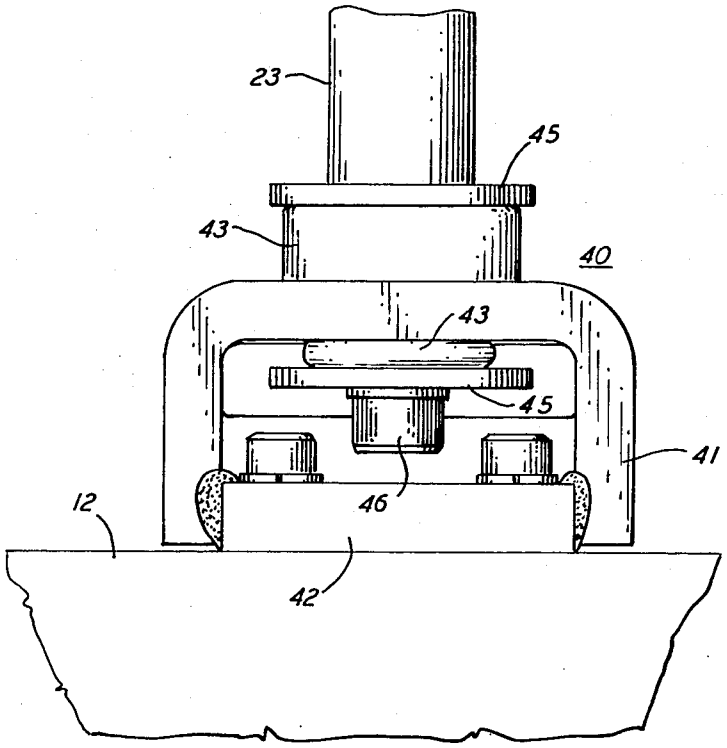
FIGS. 4 and 5 are sectional views taken along lines IV—IV and V—V, respectively, of FIG. 3.
Figure 4:
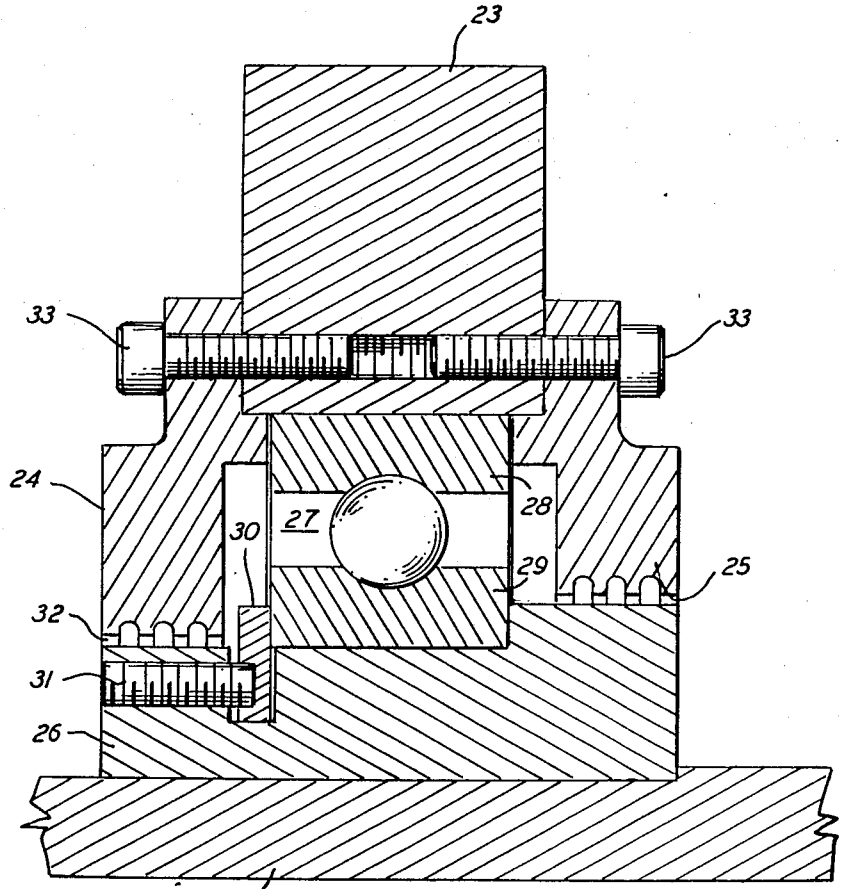

The bearing assembly 20 is resiliently mounted onto the rails 12 by a pair of flexible tube bearing supports 40, as shown in FIGS. 3 and 5. A U-shaped member 41 is welded near each end of cross member 42, and each end of cross member 42 is then bolted to a respective rail 12. A flexible resilient bushing 43, formed preferably of rubber or a rubber-like composition, is held in supporting contact with the member 41, here passing through a through-hole in the member 41. A metal sleeve 44 penetrates the bushing 43 through this through-hole. Keeper discs 45 are respectively disposed above and below the bushing 43 and a cap screw 46 fits through the sleeve 44, keepers 45, and bushing 43 into the bearing housing 23. Because of the resiliency of the bushings 43, the bearing assembly 20 and the associated tube section 15 enjoy limited freedom of movement vertically and horizontally and can sustain limited torsional movement as well.

As shown in FIG. 3, a number of wireline holes 47 penetrate the mounting ring 26 in the zone between compartment windows 48 or openings, and the keepers 30 are positioned adjacent to edges of the windows 48. This structure permits wires to pass outside the tube sections 15, 16 17 but beneath the encircling bearing inner race 29. With this structure, the difference in diameter as between the bearing 27 and the tube sections 15, 16 17 is kept as small as possible.

Also shown in FIG. 3 is an oil drip pan 49 fastened to the bearing housing 23 beneath the tube section 15.

A barrel coupling assembly 50 is shown in FIG. 2. This assembly 50 joins successive tube sections 15 and 16. The barrel coupling assembly 50 accommodates vertical and horizontal relative displacement of successive tube sections, and as well as permits angular displacement. The assembly 50 is shown in detail in FIGS. 6–9.

Figure 6:
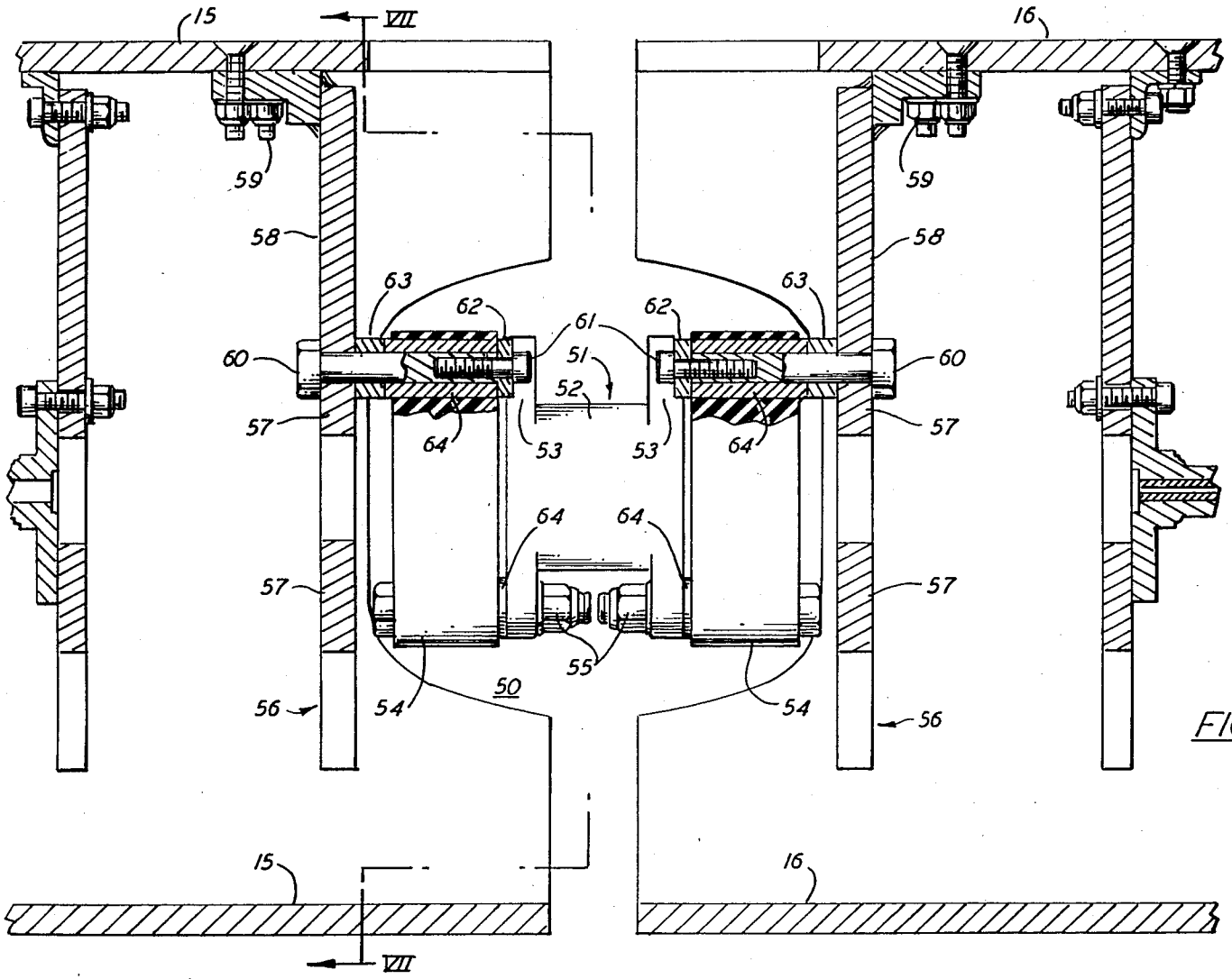
FIG. 6 is a sectional elevation, partly cut away, of a flexible barrel connector assembly of an embodiment of this invention.
Figure 7:
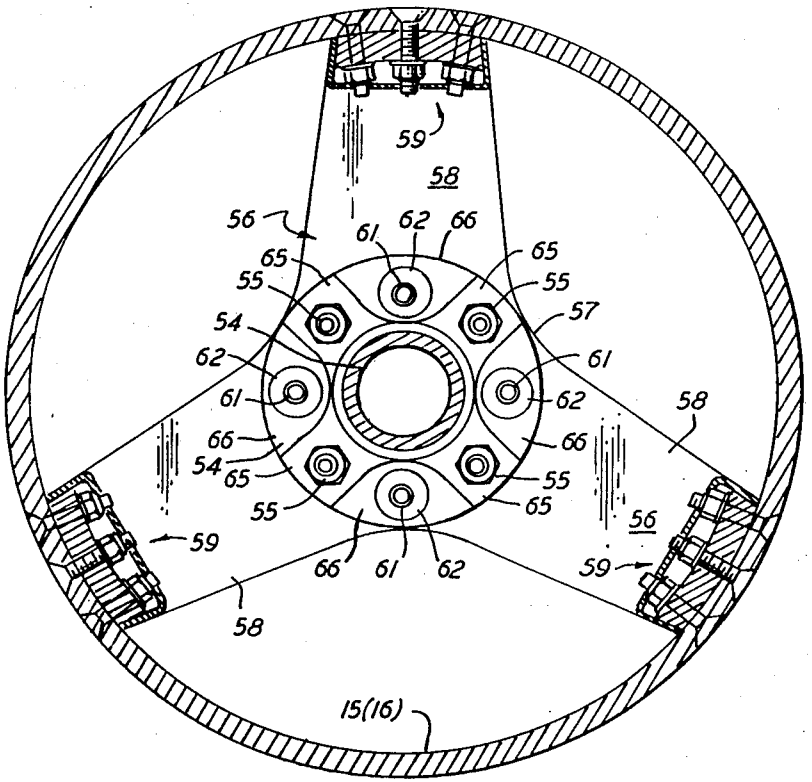
FIG. 7 is a cross section taken along lines VII—VII of FIG. 6.

As shown in FIG. 6, the barrel connector assembly 50 includes a steel or other rigid metal barrel connector 51 which has a generally cylindrical body 52 and a pair of radial end flanges 53. A pair of flexible resilient discs or rings 54, each having cylindrical metal bushings 64 bonded in place are joined by threaded fasteners 55 to the end flanges 53 of the barrel connector 51. While the flexible discs 54 are formed of an elastomer or rubber-like material, these elements could be formed instead of a composite or of metal laminations. A pair of spiders 56, as also shown in FIG. 7, each have a central hub portion 57, and a number of legs or spokes 58 which connect by bolts 59 or other fasteners to cylindrical walls of the tube sections 15, 16. Female-threaded coupling bolts 60 or sleeves extend through the spider hub portion 57 and through bushings 64 bonded into resilient rings 54. These bolts 60 receive cap screws 61 which have associated retaining washers 62. Spacers 63 are disposed between the spiders 56 and bushings 64 bonded to the flexible resilient rings 54.

Figure 8:
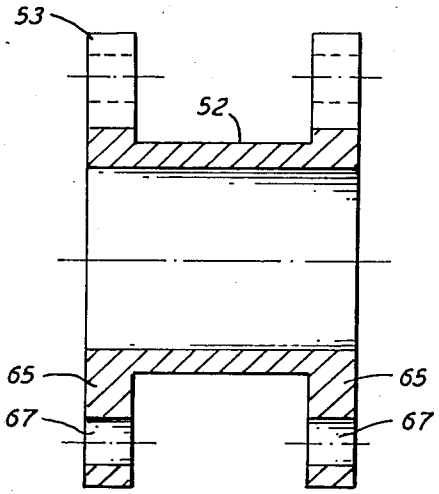
FIGS. 8 and 9 are sectional and end views of the barrel connector of this embodiment.
Figure 9:
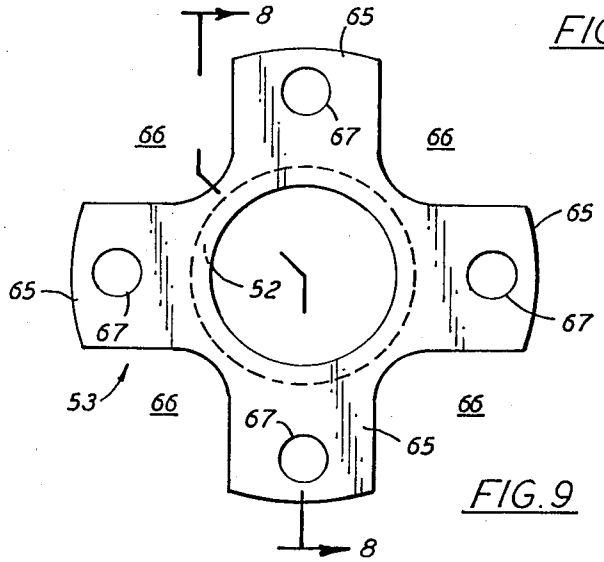

As shown in FIGS. 8 and 9, the barrel connector is formed so that its cylindrical body 52 has an open core, and each end flange 53 is divided into four lobes 65, disposed 90 degrees apart. Successive lobes 65 define spaces 66, and bolt holes 67 for the threaded fasteners 55 are provided in the lobes 65.

As shown in FIG. 7, the connections of the flexible resilient rings 54 to the associated spider hubs 57 and to the lobes 65 of the barrel connector end flanges 53 occur alternately.

It should be appreciated that the pair of flexible members 54 spaced apart by the rigid member 51 will accommodate lateral or parallel misalignment of successive tube sections 15, 16 or 16, 17, whereas connection by means of a single flexible disc or the like will accommodate only angular misalignment.

Returning to FIG. 2, the tube section 15 also includes wire pulleys 68 and grommet holders 69, which perform their conventional functions. As shown in FIG. 1, the entire arrangement according to this invention requires only four support feet 70 to support the frame 12 from the factory floor. This is a distant advantage for machines of this type in which the tube 14 has a length of about 15 meters (48 feet). Because of the flexible coupling capacity of the barrel coupling assemblies 50 and the use of flexible support rather than rigid support for the encircling bearings 20, precise alignment of the sections 15, 16, 17 is not necessary, and flatness of the factory or workplace floor is not at all critical.

Furthermore, the flexible support provided by the improvement of this invention accommodate thermal expansion which occurs from air and mechanical friction, which can increase the temperature of the tube 14 within the sound-insulated enclosure 11.

The employment of flexible bearing supports and flexible tube section connectors achieves better vibration and noise insulation, and obviates the need for precise alignment of the tube sections 15, 16, 17 with respect to each other and with respect to the frame 12.

While the invention has been described in detail hereinabove with respect to a preferred embodiment, it should be recognized that the invention is not limited to that embodiment, and that many modifications and variations thereof would present themselves to those of skill in the art without departing from the scope and spirit of this invention, as defined in the appended claims.

What is claimed is:

1. In a stranding machine for the production of rope from a plurality of strands comprising a rotary tube formed of a plurality of tube sections coupled end to end to rotate about a common axis, each said tube section including a plurality of cradles for dispensing the strands; a frame supporting said tube sections; at least one bearing rotationally supporting said tube from said frame; and at least one flexible connector connecting an end of one of said tube sections to a corresponding end of an adjacent one of said tube sections; the improvement wherein said at least one bearing includes an encircling bearing member having an inner race and an outer race, bearing mounting means for mounting said inner race into an outer surface of one said tube section, bearing housing means for holding said outer race, and flexible support means for mounting said bearing housing means to said frame; said flexible support means including a flexible resilient bushing, means mounting said bushing to said frame, and means mounting said bushing to said bearing housing.

2. The stranding machine of claim 1 wherein there are two of said encircling bearing members for at least one of said tube sections.

3. The stranding machine of claim 1 wherein said supporting frame includes a pair of support rails extending beneath and parallel to said tube, and for each said bearing housing said flexible support means includes a respective portion to support said bearing housing on the associated rail.

4. The stranding machine of claim 1 wherein said means mounting said bushing to said frame includes a U-shaped bearing support member affixed onto said frame and in supporting contact with said flexible resilient bushing.

5. The stranding machine of claim 4 in which said means mounting said bushing to said bearing housing includes a sleeve within said bushing, a pair of keepers disposed adjacent upper and lower surfaces of said bearing, and a threaded fastener disposed through said sleeve and into said bearing housing.

6. In a stranding machine for the production of rope from a plurality of strands, comprising a rotary tube formed of a plurality of tube sections coupled end to end to rotate about a common axis, each said tube section including a plurality of cradles for dispensing the strands; a frame supporting said tube sections; at least one bearing rotationally supporting said tube from said frame; and at least one flexible connector connecting and end of one of said tube sections to a corresponding end of an adjacent one of said tube sections; the improvement wherein said flexible connector includes a pair of spiders each having a central mounting hub and a plurality of radial spokes where ends are affixed to an associated one of said tube sections; a barrel connector including a generally cylindrical body and radial flanges at opposite ends of said cylindrical body; a pair of resilient flexible coupling members; first fastener means for connecting said spider mounting hubs to said flexible coupling members; and second fastener means for connecting said flexible coupling members to respective ones of said barrel connector end flanges.

7. The stranding machine of claim 6 wherein said barrel connector end flanges are each formed of a plurality of lobes which define openings therebetween; and wherein said first fastener means are disposed at the positions of said openings while said second fastener means are disposed at the positions of said lobes, such that the connections of said flexible coupling members to the associated spider hub and to the associated barrel connector flange occur alternately.

8. The stranding machine of claim 6 wherein said first fastener means include metal sleeves which penetrate the associated flexible coupling members.

9. The stranding machine of claim 8 in which said metal sleeves are female threaded, and said first fastener means further include retaining screws respectively holding the associated flexible coupling member on said metal sleeves.

10. The stranding machine of claim 6 wherein said coupling members are rings of a rubber-like material.

11. The stranding machine of claim 6 wherein said coupling members are of metal laminations.

12. The stranding machine of claim 6 wherein said coupling members are of a composite material.

* * * * *